US010124862B2

(12) United States Patent
Arote et al.

(10) Patent No.: US 10,124,862 B2
(45) Date of Patent: Nov. 13, 2018

(54) CLEAT ATTACHABLE DEVICE

(71) Applicants: Richard Arote, Lynbrook, NY (US); Robert Dickie, King City (CA); Shahram Nabavi, King City (CA)

(72) Inventors: Richard Arote, Lynbrook, NY (US); Robert Dickie, King City (CA); Shahram Nabavi, King City (CA)

(73) Assignee: Land A Line Holdings, LLC

( * ) Notice: Subject to any disclaimer, the term of this patent is extended or adjusted under 35 U.S.C. 154(b) by 0 days.

(21) Appl. No.: 15/662,390

(22) Filed: Jul. 28, 2017

(65) Prior Publication Data

US 2018/0009510 A1 Jan. 11, 2018

Related U.S. Application Data

(63) Continuation-in-part of application No. 15/069,207, filed on Mar. 14, 2016, now Pat. No. 9,758,219.

(51) Int. Cl.
*B63B 21/04* (2006.01)

(52) U.S. Cl.
CPC ..... *B63B 21/045* (2013.01)

(58) Field of Classification Search
CPC ..... B63B 21/045
See application file for complete search history.

(56) References Cited

U.S. PATENT DOCUMENTS 3,477,106 A * 11/1969 Tetzlaff ..... F16L 33/02 24/279
3,996,876 A * 12/1976 Sinclair ..... B63B 21/06 114/218
4,488,502 A * 12/1984 Girard ..... E02B 3/24 114/230.26
5,806,452 A * 9/1998 Benoit ..... B63B 21/08 114/218
7,124,699 B1 * 10/2006 Clark ..... E02B 3/20 114/218
2004/0094071 A1 * 5/2004 Goeller ..... A01K 97/10 108/42
2006/0065179 A1 * 3/2006 Lawrence ..... B63B 21/00 114/230.13
2012/0017818 A1 * 1/2012 Arote ..... E02B 3/24 114/218
2018/0020651 A1 * 1/2018 Larkin ..... A01K 97/10 43/21.2

* cited by examiner

*Primary Examiner* — Stephen P Avila
(74) *Attorney, Agent, or Firm* — Robert M. Schwartz; Alfred K. Dassler

(57) ABSTRACT

A cleat attachable device for attaching to a cleat having horns. The device includes a frame having a base end, a distal end opposite the base end, and lateral posts. The lateral posts are disposed opposite one another and are connected to one another at the distal end. The lateral posts each have a respective mounting plate with a longitudinal slot formed therein. A stud plate has an underside for resting on the cleat. The stud plate has two studs opposite the underside for receiving the mounting plates thereon and securing the frame to the cleat.

15 Claims, 17 Drawing Sheets

Detail A

CLEAT ATTACHABLE DEVICE

CROSS-REFERENCE TO RELATED APPLICATION

This application is a continuation-in-part of U.S. application Ser. No. 15/069,207, filed Mar. 14, 2016. The prior application is incorporated herein by reference in its entirety.

FIELD OF THE INVENTION

Background of the Invention

The invention relates to a device for attaching to a cleat, more specifically, to a frame device for assisting in attaching a docking line with a looped end.

Description of the Related Art

The present invention embodies a frame device for assisting in attaching a docking line with a looped end.

Horn cleats or devices for attaching lines are used generally on docks. Docks generally have a side which allows for a vessel to pull up and tie up to the dock. Horn cleats, well known in the art, are typically made of a metal and include two horns affixed to spars, an opening is typically present in the center of the cleat between the spars.

U.S. Pat. No. 6,155,191 to Weaver discloses a cleat bracket having a first end with a z-shape, which allows the bracket to be attached to the cleat. The bracket includes a straight portion having a hook for holding accessories such as a lantern. The bracket of Weaver is not suitable for assisting in placing a loop of a line around horns of the cleat.

U.S. Pat. No. 8,544,401 to Arote discloses a cleat attachable device having several embodiments. The embodiments include different constructions for setting the relationship of lateral posts relative to the ends of the horns of the cleat. A first embodiment shown in FIG. 1 of Arote discloses lateral posts that are fixed with respect to one another and have cross-members affixed between them that sets a distance of the lateral sides of the lateral posts.

SUMMARY OF THE INVENTION

It is accordingly an object of the invention to provide a cleat attachable device which overcomes the above-mentioned disadvantages of the heretofore-known devices of this general type and which provides a device for assisting in attaching a docking line with a looped end, which is easy-to-use and easy to assemble.

With the foregoing and other objects in view there is provided, in accordance with the invention a cleat attachable device for attaching to a cleat having horns, the device having a frame having a base end, a distal end opposite the base end, and lateral posts, the lateral posts being disposed opposite one another and being connected to one another at the distal end, the lateral posts each having a respective mounting plate with a longitudinal slot formed therein, a stud plate having an underside for resting on the cleat, the stud plate having two studs opposite the underside for receiving the mounting plates thereon and securing the frame to the cleat.

In accordance with another feature of the invention, the stud plate has opposing sidewalls, inner sides of the sidewalls have a profile that corresponds to a profile of a corresponding cross section of the cleat.

In accordance with a further feature of the invention, each of the sidewalls have a respective hole formed therein in a position that corresponds to an opening of the cleat for receiving a bolt to secure the stud plate to the cleat In accordance with an added feature of the invention, the mounting plates each have bosses for attaching to a respective one of the lateral posts.

In accordance with an additional feature of the invention, the mounting plates each have a respective shoulder on an underside thereof for abutting against an end of a horn of the cleat.

In accordance with another mode of the invention, the cooperating clamp plates each having a respective top surface and a sidewall extending from the top surface, the top surface having two slotted openings spaced apart at the distance of the studs, the slotted openings permitting the clamp plates to be positioned on the studs with each respective sidewall abutting against the cleat.

In accordance with a further mode of the invention, each sidewall has a tab for engaging an opening in the cleat when each respective sidewall abuts against the cleat.

In accordance with an additional mode of the invention, the mounting plates each have bosses for attaching to a respective one of the lateral posts.

In accordance with still a further mode of the invention, the mounting plates each have a respective shoulder on an underside thereof for abutting against an end of a horn of the cleat.

Other features which are considered as characteristic for the invention are set forth in the appended claims.

Although the invention is illustrated and described herein as embodied in a cleat attachable device, it is nevertheless not intended to be limited to the details shown, since various modifications and structural changes may be made therein without departing from the spirit of the invention and within the scope and range of equivalents of the claims.

The construction and method of operation of the device, however, together with additional objects and advantages thereof will be best understood from the following description of specific embodiments when read in connection with the accompanying drawings.

DESCRIPTION OF THE PREFERRED EMBODIMENTS

Figure 1:
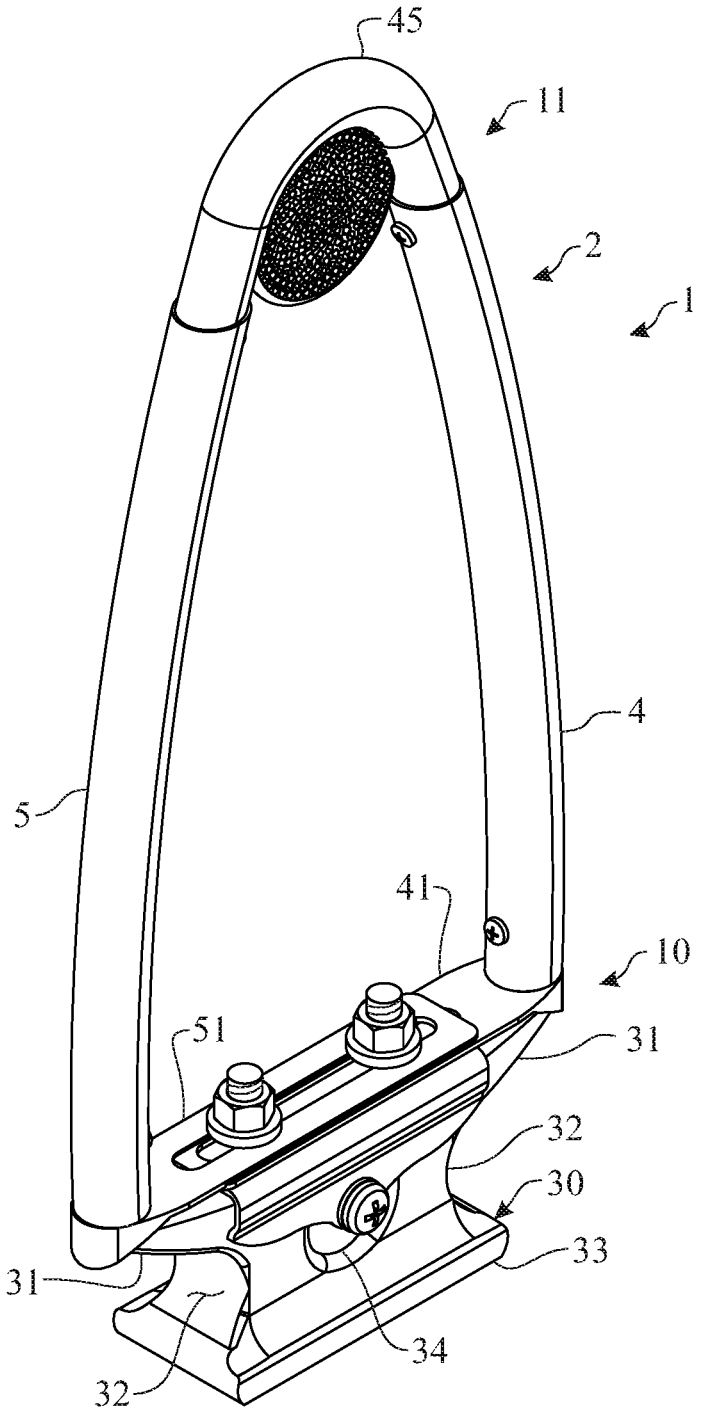
FIG. 1 is a perspective view of a first embodiment of the of the device mounted on a cleat.
Figure 2:
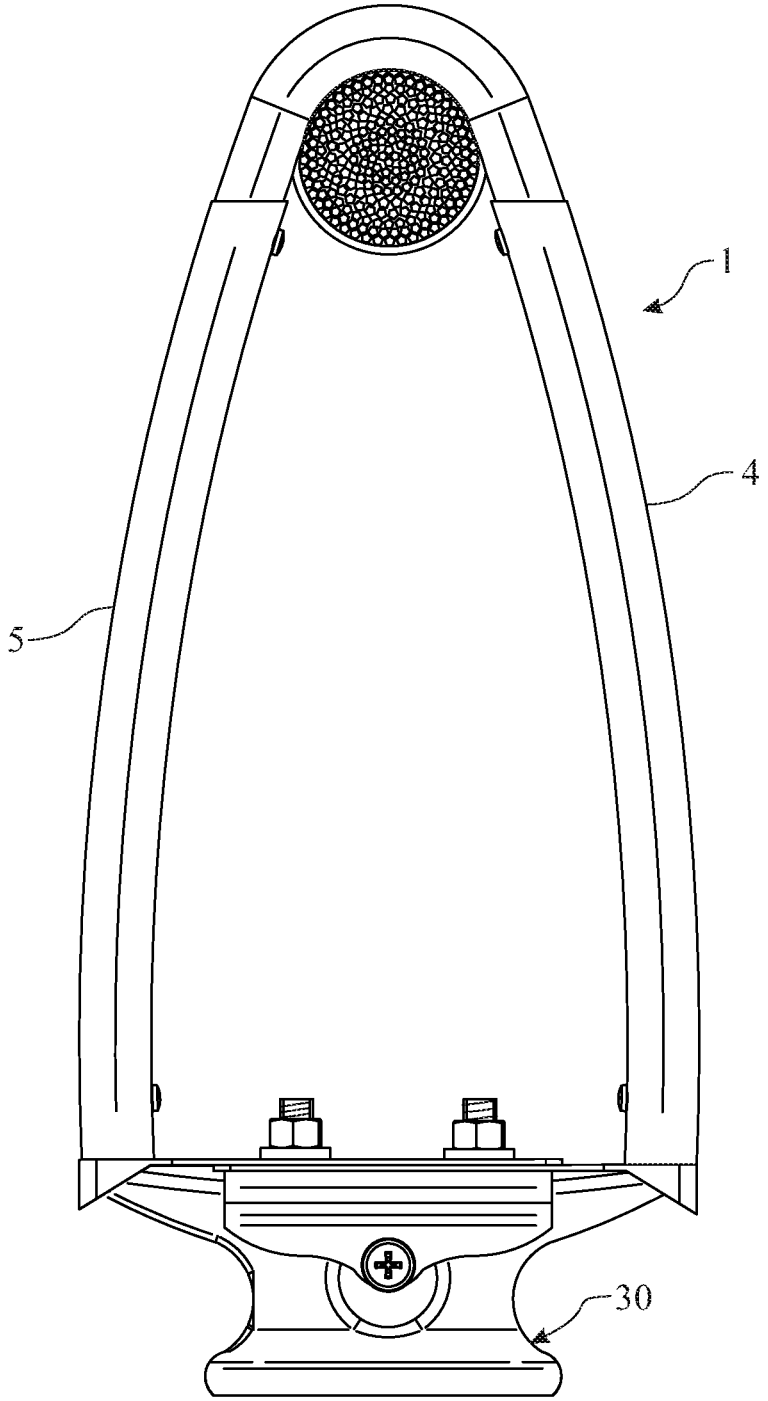
FIG. 2 is a side elevational view of the first embodiment of the device mounted on a cleat.
Figure 3A:
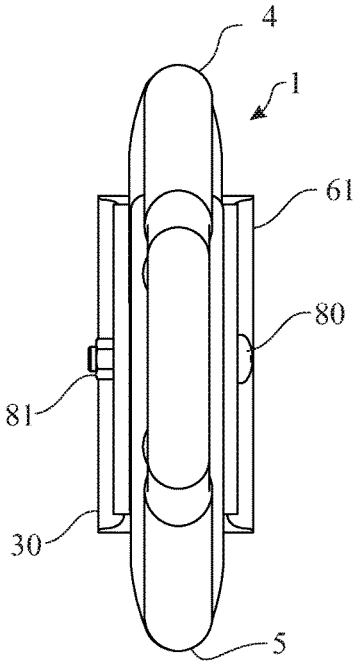
FIG. 3A is a top view of the first embodiment of the device mounted on a cleat.
Figure 3B:
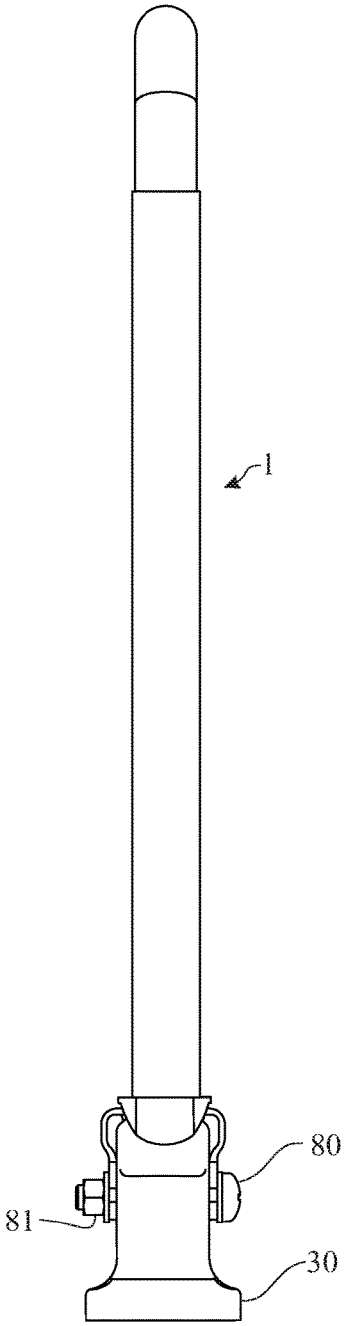
FIG. 3B is an end view of the first embodiment of the device mounted on a cleat.

Referring now to the figures of the drawing in detail and first, particularly, to FIG. 1 thereof, there is seen a cleat attachable device 1 having a frame 2. The device 1 is shown mounted on a cleat 30 which has horns 31, spars 32, a mounting foot 33 and opening 34 between the spars 32. The frame 2 includes lateral posts 4, 5 disposed opposite one another. The frame 2 has a base end 10 configured to be mounted to the cleat 30 and a distal end 11 opposite the base end 10. The lateral posts 4, 5 converge towards the distal end 11 and are attached to one another at the distal end 11 by a connection piece 45. The connection piece 45 may be provided as a curved piece to allow a loop 70 of a line 71 to easily pass over the distal end 11 and down the lateral posts 4, 5. The frame 2 has respective mounting plates 41, 51 mounted to said lateral posts 4, 5, at the base end 10. The mounting plates 41, 51 project towards one another and each has a respective end surface that matches the outer profile of the lateral posts 4, 5. This matching at the end surfaces prevents the line from becoming snagged at the transition between the mounting plates 41, 51 and the lateral posts 4, 5.

It is possible for the lateral posts 4, 5 to be provided as tubes and for the mounting plates 41, 51 to be provided with bosses 43, 53 which are received inside the tubes 4, 5. A mechanical fastener 49 may be provided for further securing the lateral posts 4, 5 to the bosses 43, 53. Alternatively, it is possible for the bosses 43, 53 to be provided as cups which receive the lateral posts 4, 5. In this case, it is preferable for the posts 4, 5 to have a step so that the outside diameter of the posts 4, 5 matches the outside diameter of the cups to prevent any possible snagging points.

The mounting plates 41, 51 are provided with respective slots 41*s*, 51*s* that are provided to attach the device 1 to the cleat 30. The slots 41*s*, 51*s* extend in a longitudinal direction of the mounting plates 41, 51 for setting a distance between the lateral posts 4, 5 (in the manner described below) to accommodate the length over the horns 31 of different size cleats 30. On an underside, each of the mounting plates 41, 51 is provided with a respective shoulder 42, 52. The shoulders 42 and 52 abut against the ends of the horns 31 and help to set the size of the frame 2 and assist in guiding the loop 70 over the horns 31 into a secure position on the cleat 30.

Figure 4:
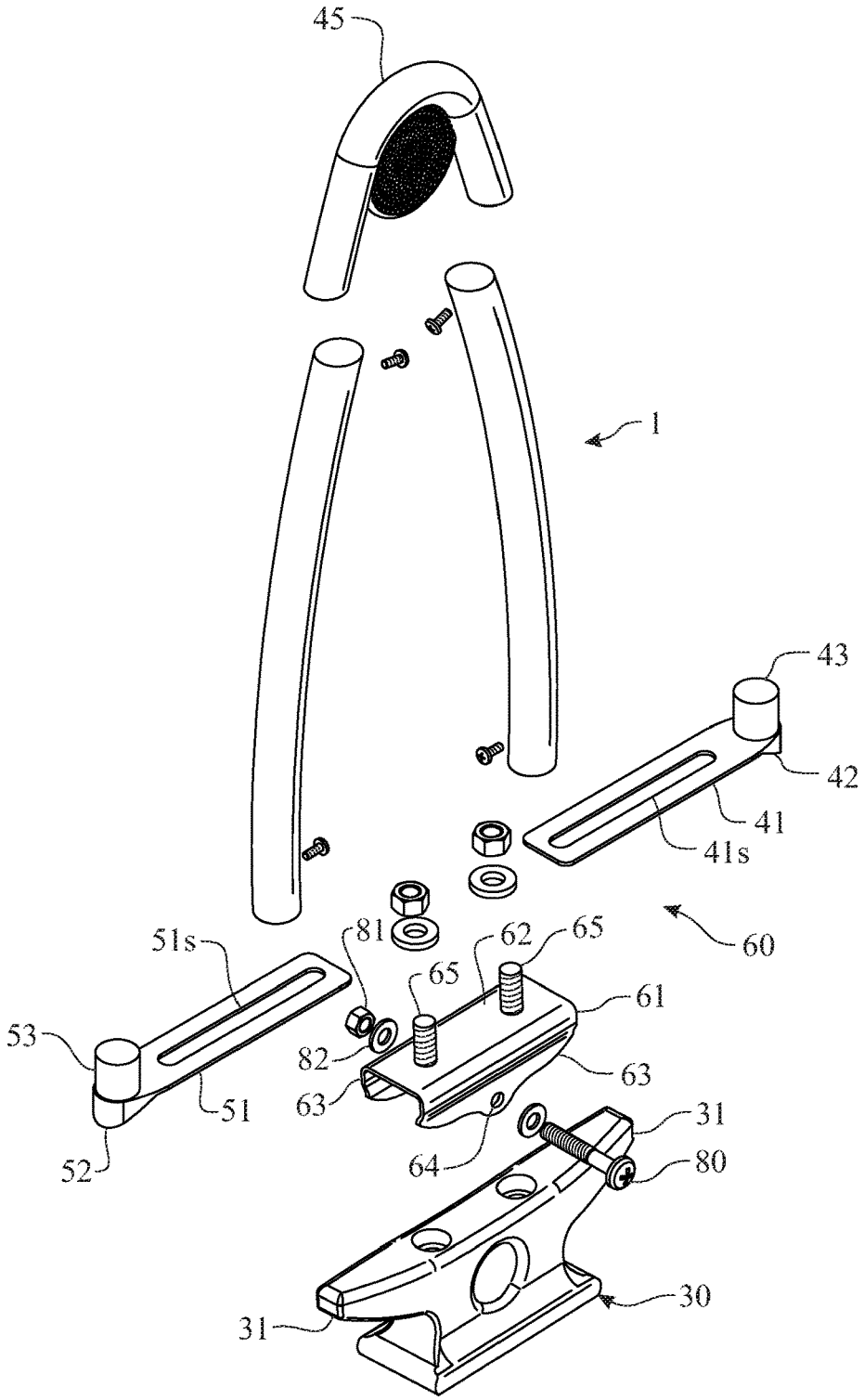
FIG. 4 is an exploded assembly of the first embodiment of the device in an unmounted state.
Figure 5:
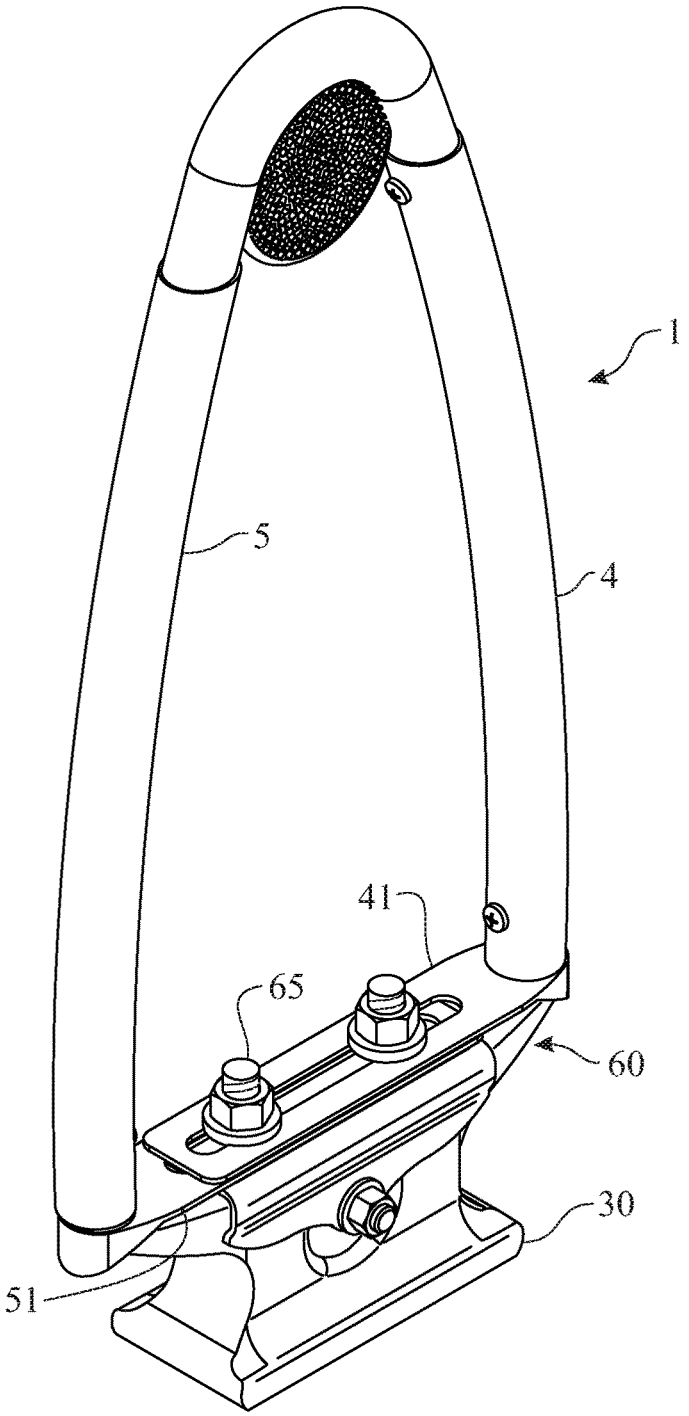
FIG. 5 is a perspective view of a second embodiment of the of the device mounted on a cleat.

The mounting plates 41, 51 are fixed to the cleat 30 by a bracket assembly 60. In FIG. 4, the bracket assembly 60 has a clamp plate/stud plate 61. The clamp plate 61 has a top surface 62 and opposing sidewalls 63 extending from the top surface 62. The sidewalls 63 are each provided with a respective holes 64 for accommodating a screw 80. The screw 80 passes through one of the holes 64 and then through the opening 34 of the cleat 30 and through the opposite hole 64, where it is then provided with a nut 81. It is also possible for washers 82 to be provided between the screw head and the corresponding sidewall 63 and between the nut 81 and the corresponding sidewall 63. Here, when considering a cross section of the clamp plate 61 an inner side of the sidewalls 63 has a profile that corresponds to the profile of a corresponding cross section of the cleat 30. There are two studs 65 projecting from the top surface 62 of the clamp plate 61. The studs 65 are aligned along a centerline of the top surface 62. The studs 65 receive the slots 41*s* and 51*s* of the mounting plates 41 and 51 and nuts 83 are threaded onto the studs 65 for securing the mounting plates 41 and 51 and thus the frame 2 to the cleat 30. In use, the plates 41 and 51 are placed over the studs 65 and the nuts 83 can be snugged down to a level that allows the mounting plates 41 and 51 to be moved toward one another until the inner sides of the shoulders 42, 52 abut the ends of the horns. Once set with the ends of the horns 31 are against the shoulders 42, 52, the nuts 83 are further tightened to firmly secure the frame 2 to the cleat 30.

Figure 6:
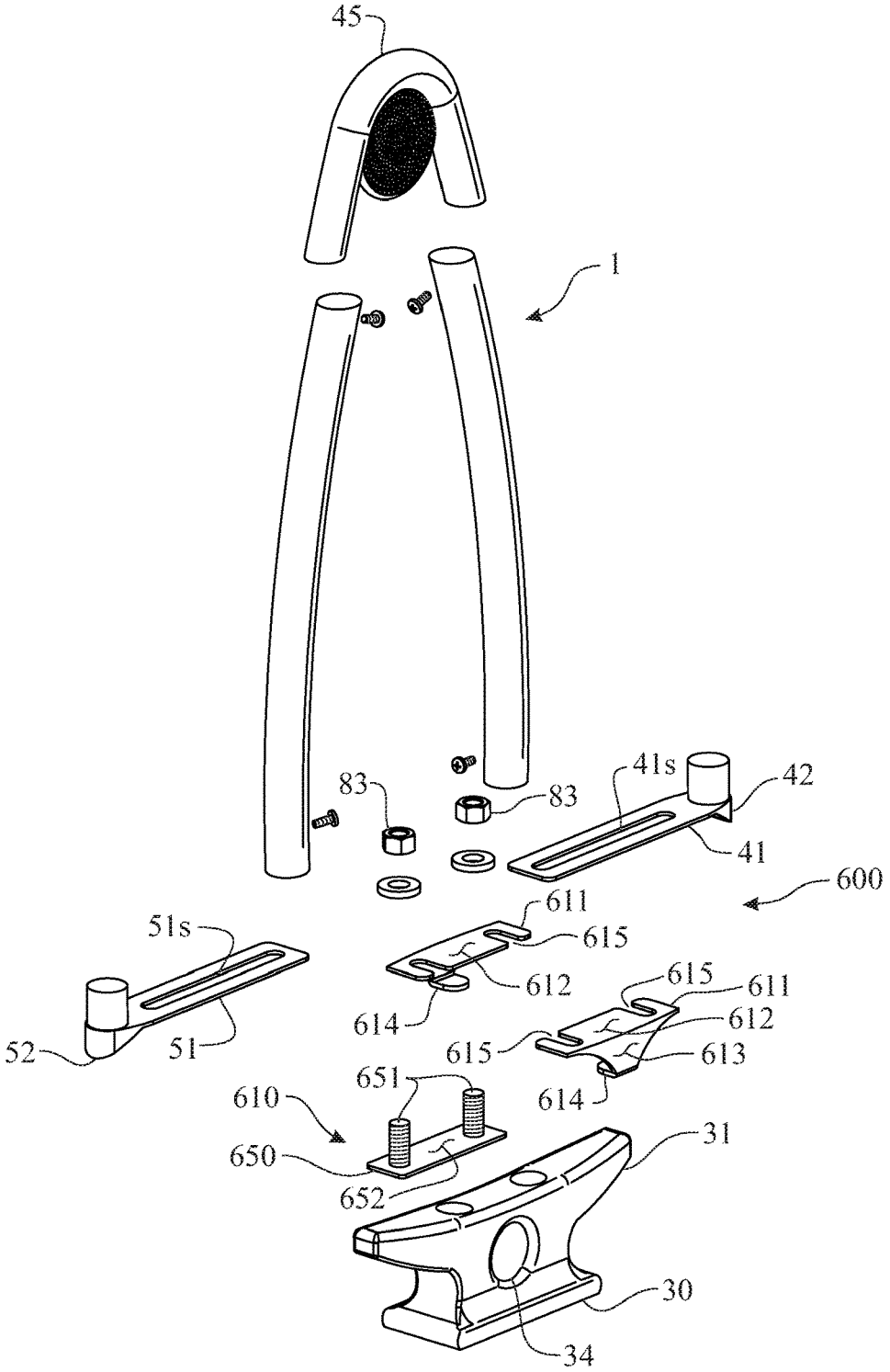
FIG. 6 is an exploded assembly of the second embodiment of the device in an unmounted state.
Figure 7:
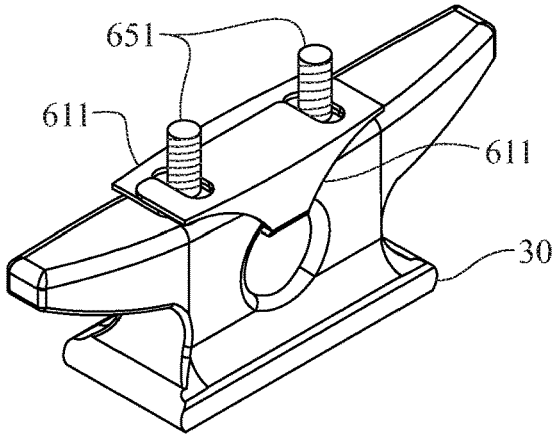
FIG. 7 is a perspective view from above of a portion of the device of the second embodiment on a cleat.
Figure 8:
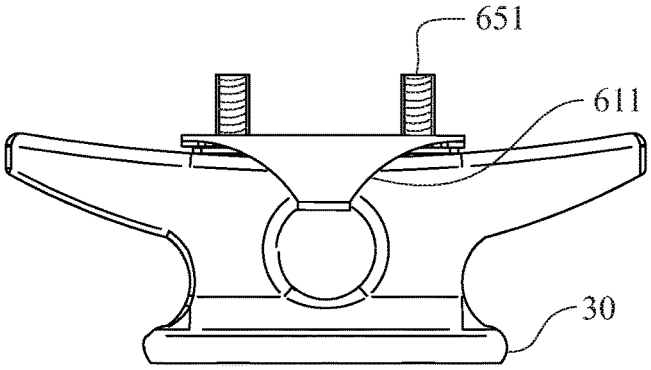
FIG. 8 is a side view of a portion of the of the device of the second embodiment on a cleat.
Figure 9:
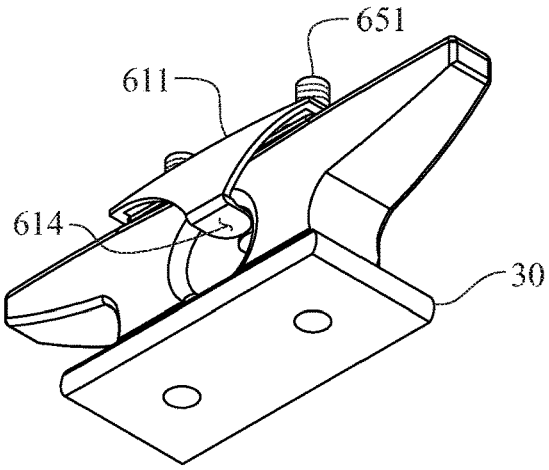
FIG. 9 is a perspective view from below of a portion of the device of the second embodiment on a cleat.
Figure 10:
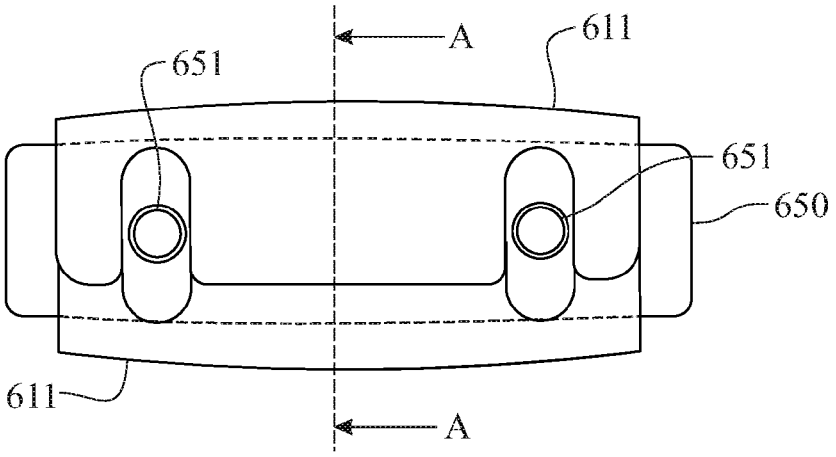
FIG. 10 is a top view of mounting components of the device of the second embodiment positioned in a position accommodating a smaller cleat.
Figure 11:
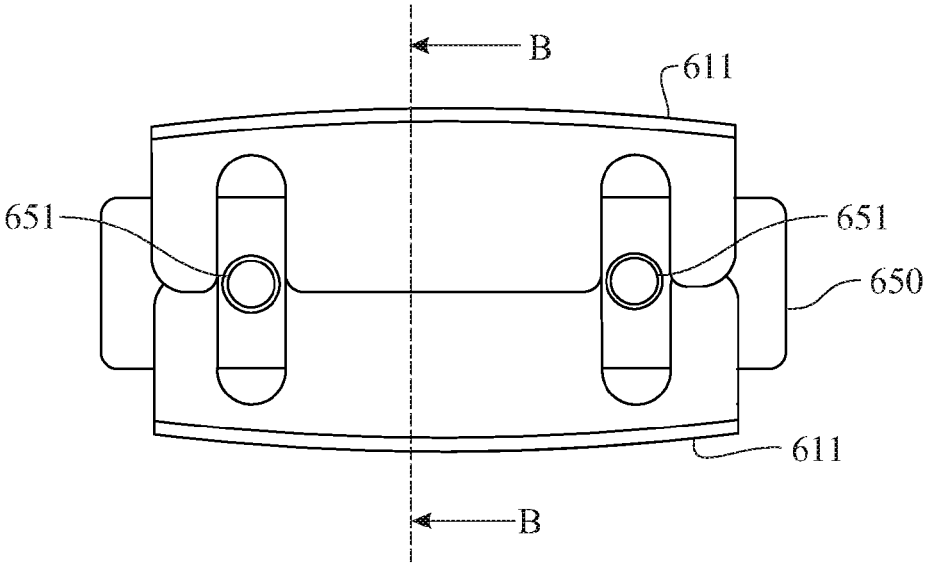
FIG. 11 is a top view of mounting components of the device of the second embodiment positioned in a position accommodating a larger cleat.

FIG. 6 shows a second embodiment of the cleat attachable device 1. Here, the mounting plates 41, 51 are fixed to the cleat 30 by a bracket assembly 600. In FIG. 6, the bracket assembly 600 has a clamp plate sub-assembly 610. The clamp plate sub-assembly 610 has cooperating clamp plates 611 each having a respective top surface 612 and a sidewall 613 extending from the top surface 612. The sidewalls 613 are each provided with a respective tab 614 opposite the top surface 612. The clamp plate sub-assembly 610 also includes a stud plate 650 with two studs 651 projecting from a top surface 652 of the stud plate 650. The studs 651 are aligned along a centerline of the top surface 652. The top surfaces 612 of the clamp plates 611 are each provided with two respective slotted openings 615, which are spaced apart at the distance of the studs 651. In use, the studs 651 receive the slotted openings 615 as well as the slots 41*s* and 51*s* of the mounting plates 41 and 51. Then the nuts 83 are threaded onto the studs 65 for securing the mounting plates 41 and 51 and thus the frame 2 to the cleat 30. During mounting, clamp plates 611 and the plates 41 and 51 are placed over the studs 65 and the nuts 83 can be snugged down to a level that allows the mounting plates 41 and 51 to be moved toward one another until the inner sides of the shoulders 42, 52 abut the ends of the horns. The clamp plates 611 can be pushed towards one another such that the tabs 614 are pushed into the opening 34 of the cleat and the sidewalls 613 are pressed against the cleat 30. This allows the clamp plate sub-assembly 610 to accommodate cleats of different widths. Once set, the sidewalls 613 clamp the cleat there between and the ends of the horns 31 are against the shoulders 42, 52, the nuts 83 are further tightened to secure the frame 2 to the cleat 30.

Figure 12:
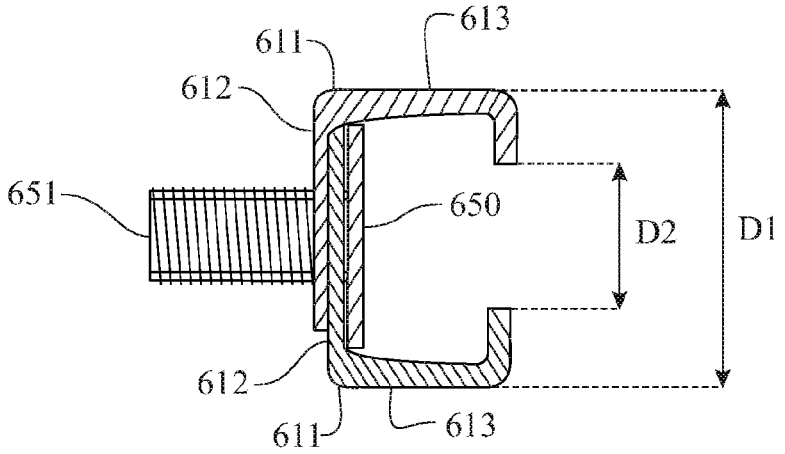
FIG. 12 is a section view of FIG. 10 along A-A with the cleat omitted.
Figure 13:
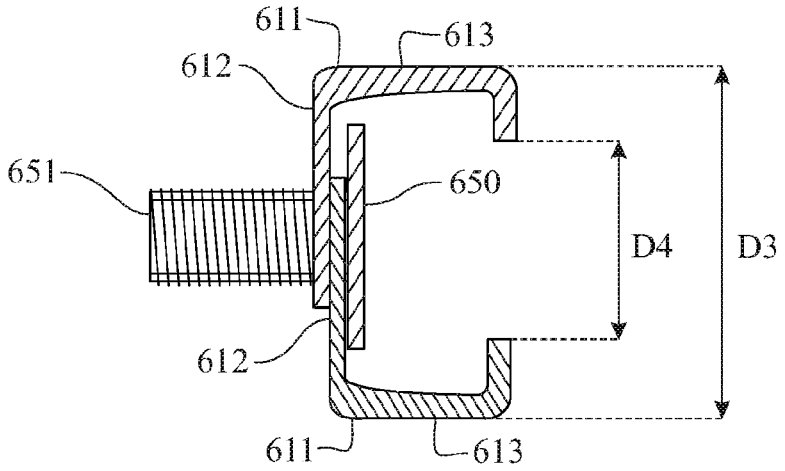
FIG. 13 is a section view of FIG. 11 along B-B with the cleat omitted.
Figure 14:
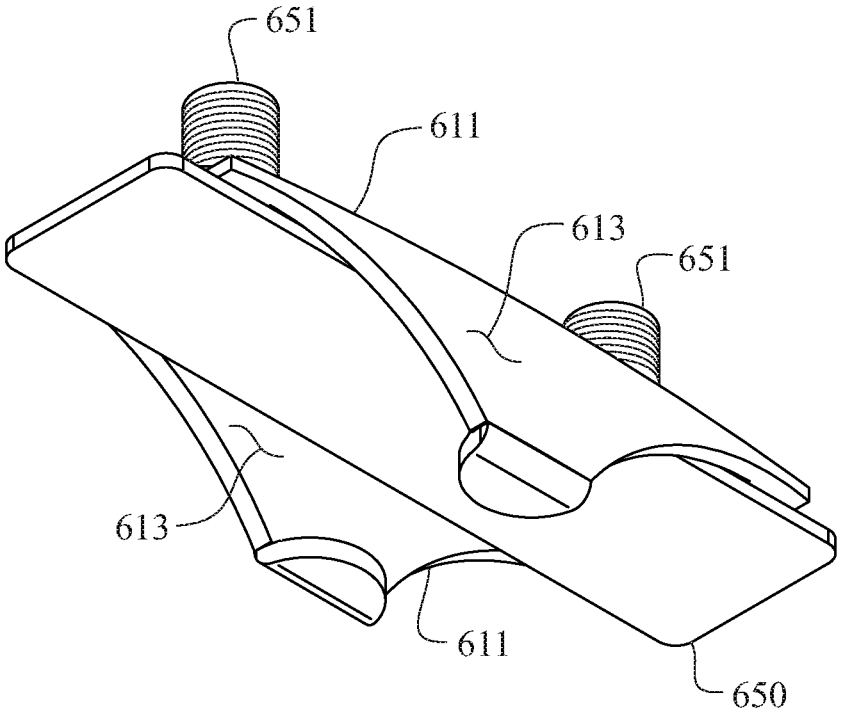
FIG. 14 is a perspective view of an underside of the mounting components of the device with the cleat omitted.

FIGS. 12 and 13 show the top surfaces 612 with varying overlap to accommodate different cleat thicknesses of different size cleats 30. These figures also show the stack up of the elements, namely that the stud plate 650 abuts the cleat 30 and then the clamp plates 611 are placed on top of the stud plate 650. Not shown, is the mounting plates 41, 51 would follow.

Figure 17:
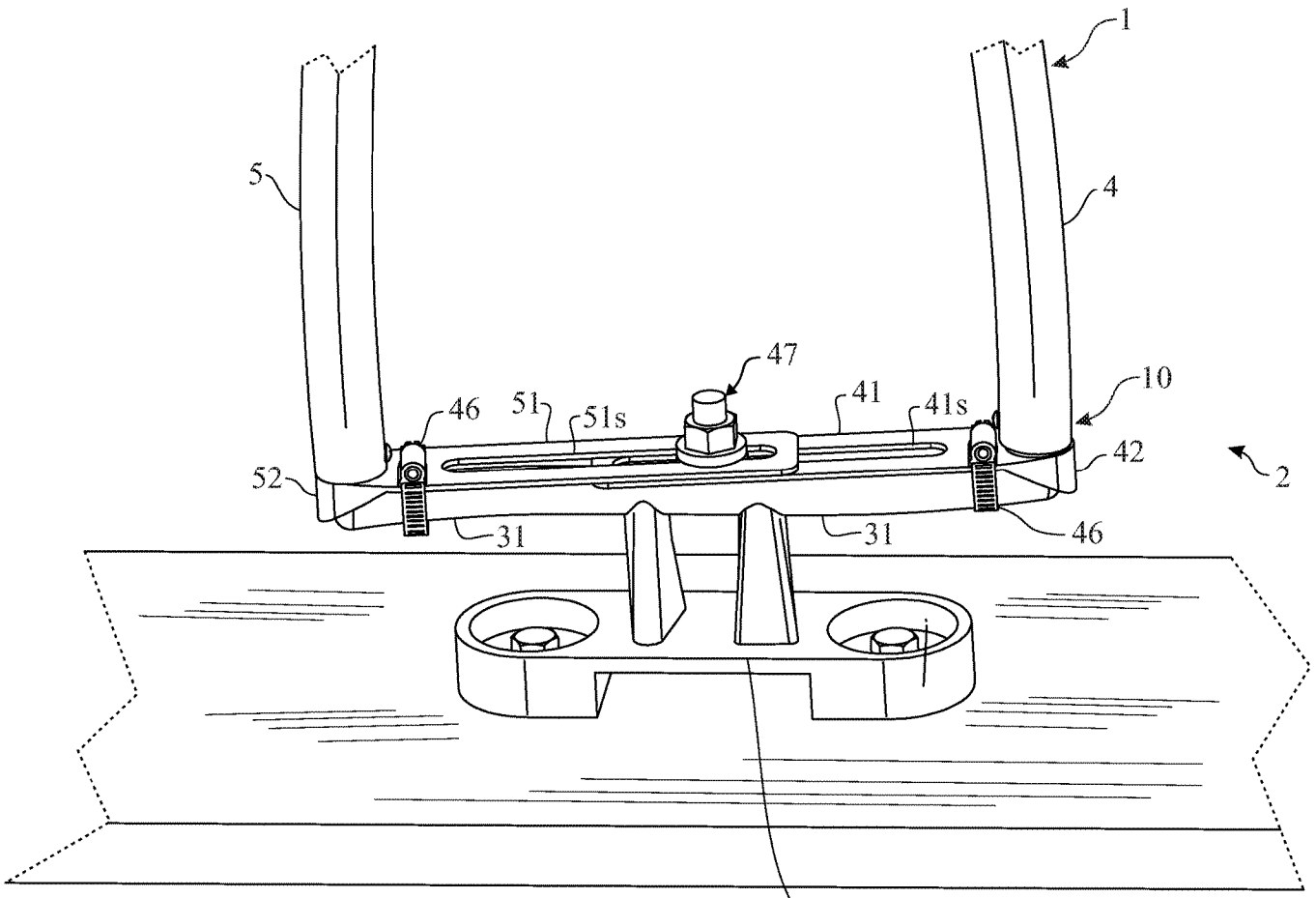
FIG. 17 is side view of fourth embodiment of a cleat attachable device mounted on a cleat.

FIG. 17 shows the base end 10 of another embodiment of the device. Here, the frame 2 again includes lateral posts 4, 5 disposed opposite one another and the distal end 11 (not shown) opposite the base end 10 is the same as the other embodiments. As in the other embodiments, the mounting plates 41, 51 are provided with respective slots 41*s*, 51*s* that are provided to attach the device 1 to the cleat 30. Here again, slots 41*s*, 51*s* extend in a longitudinal direction of the mounting plates 41, 51 for setting a distance between the lateral posts 4, 5 (in the manner described below) to accommodate the length over the horns 31 of different size cleats 30. On an underside, each of the mounting plates 41, 51 is provided with a respective shoulder 42, 52. The shoulders 42 and 52 abut against the ends of the horns 31 and help to set the size of the frame 2 and assist in guiding the loop 70 over the horns 31 into a secure position on the cleat 30.

Figure 18:
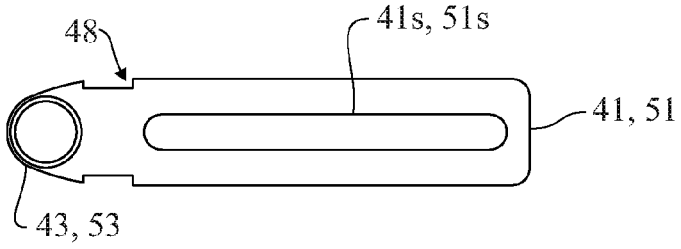
FIG. 18 is a perspective view of a mounting plate of the cleat attachable device of FIG. 17.

The embodiment of FIG. 17 differs in the construction of the mounting for connection to the cleat 30. In particular, applicants discovered that certain cleats have a general S-shape profile when viewed from above. The previous embodiments had difficulty in mounting to such a shape and the embodiment of FIG. 17 is better suited to accommodate an S-shaped cleat. FIG. 17 shows that each of the mounting plates 41, 51 is provided with a respective hose clamp 46 that is placed around the mounting plate 41, 51 and the corresponding horn 31 and is tightened to secure the device on the cleat 30. A fastener 47 passes through the slots 41*s*, 51*s* and sets the distance between the lateral posts 4, 5. As shown in FIG. 18, the mounting plates 41, 51 are provided with opposing notches 48 adjacent the lateral posts (the position of which is seen from the boss 43, 53). The notches 48 accommodate the hose clamp 46 therein. The adjustability of the hose clamp 46 allows the hose clamp 46 to accommodate the different geometries of various cleats in a particularly effective manner.

Figure 15:
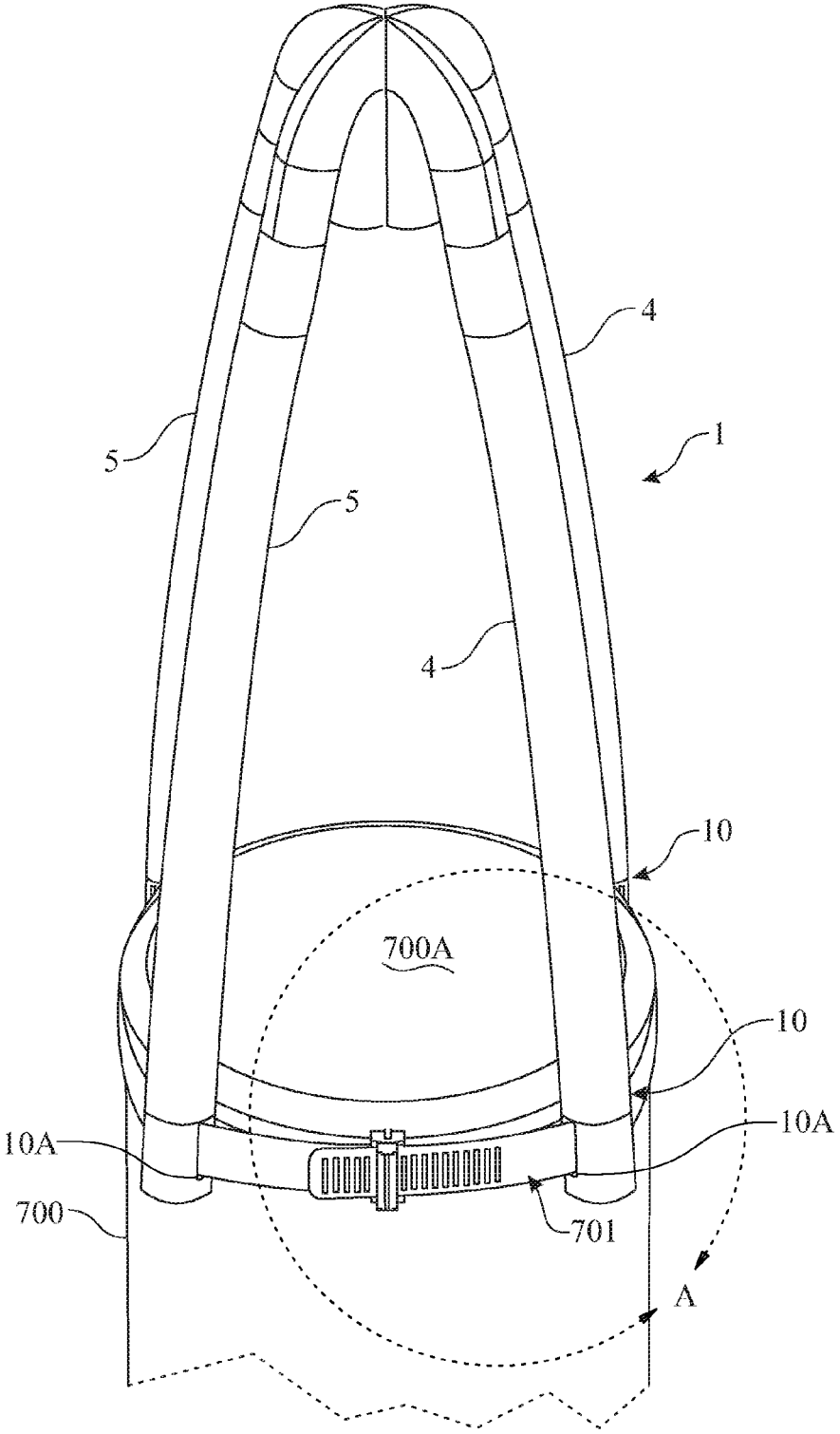
FIG. 15 is perspective view of a third embodiment of the of the device for mounting on a piling.
Figure 16:
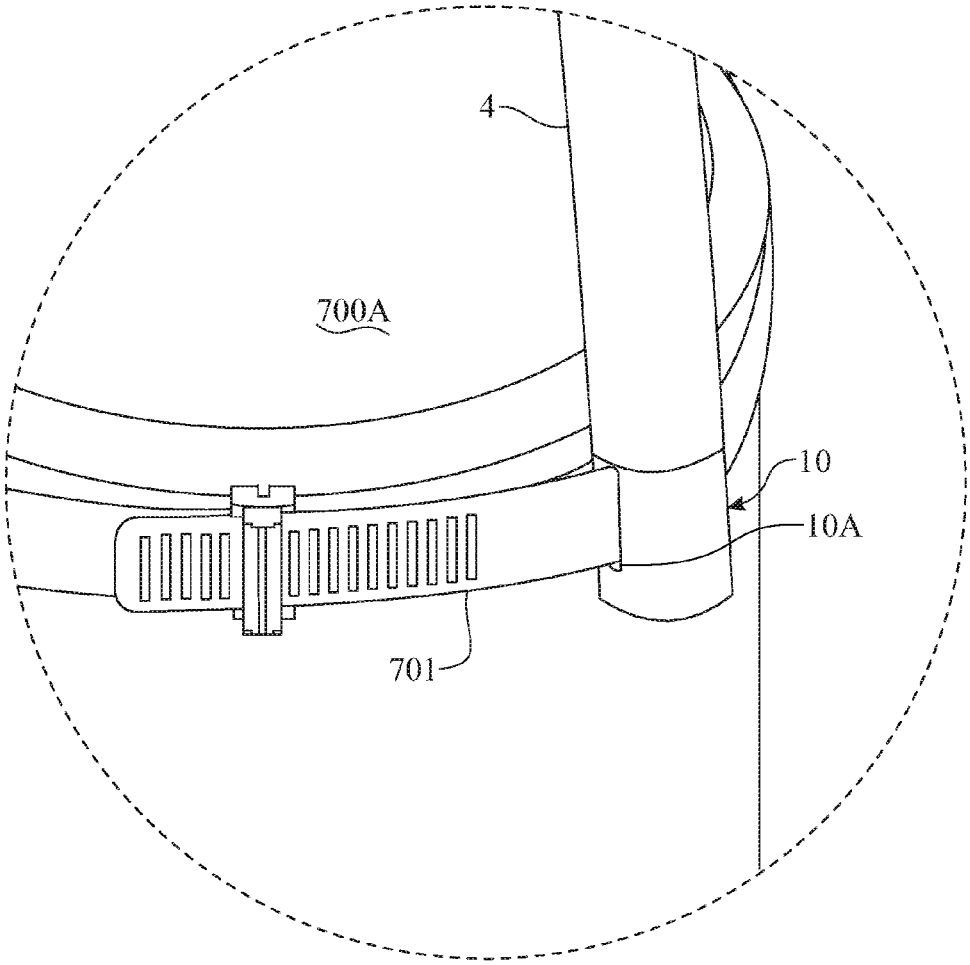
FIG. 16 is an enlarged view of detail A of FIG. 15.

FIGS. 15 and 16 show another embodiment of the device 1, which provides for mounting the device 1 to a piling 700. Here, there are at least three lateral posts and the base ends 10 of the lateral posts are provided with a slot 104 for receiving a screw clamp 701 which allows the lateral post to be tightened down onto a dock piling 700 having a top surface 700A.

Figure 19A:
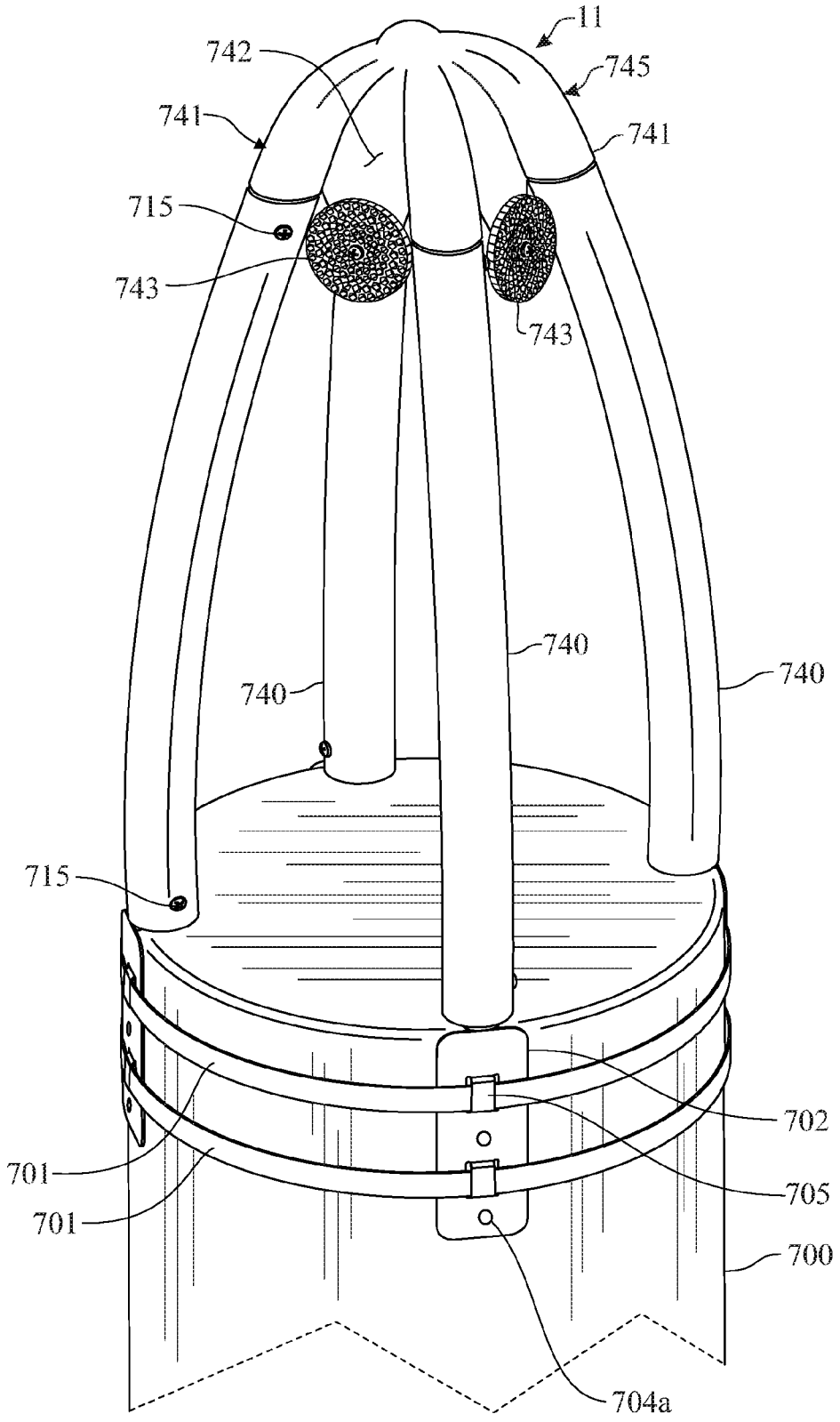
FIG. 19A is a perspective view of a fifth embodiment of the of the device for mounting on a piling.
Figure 19B:
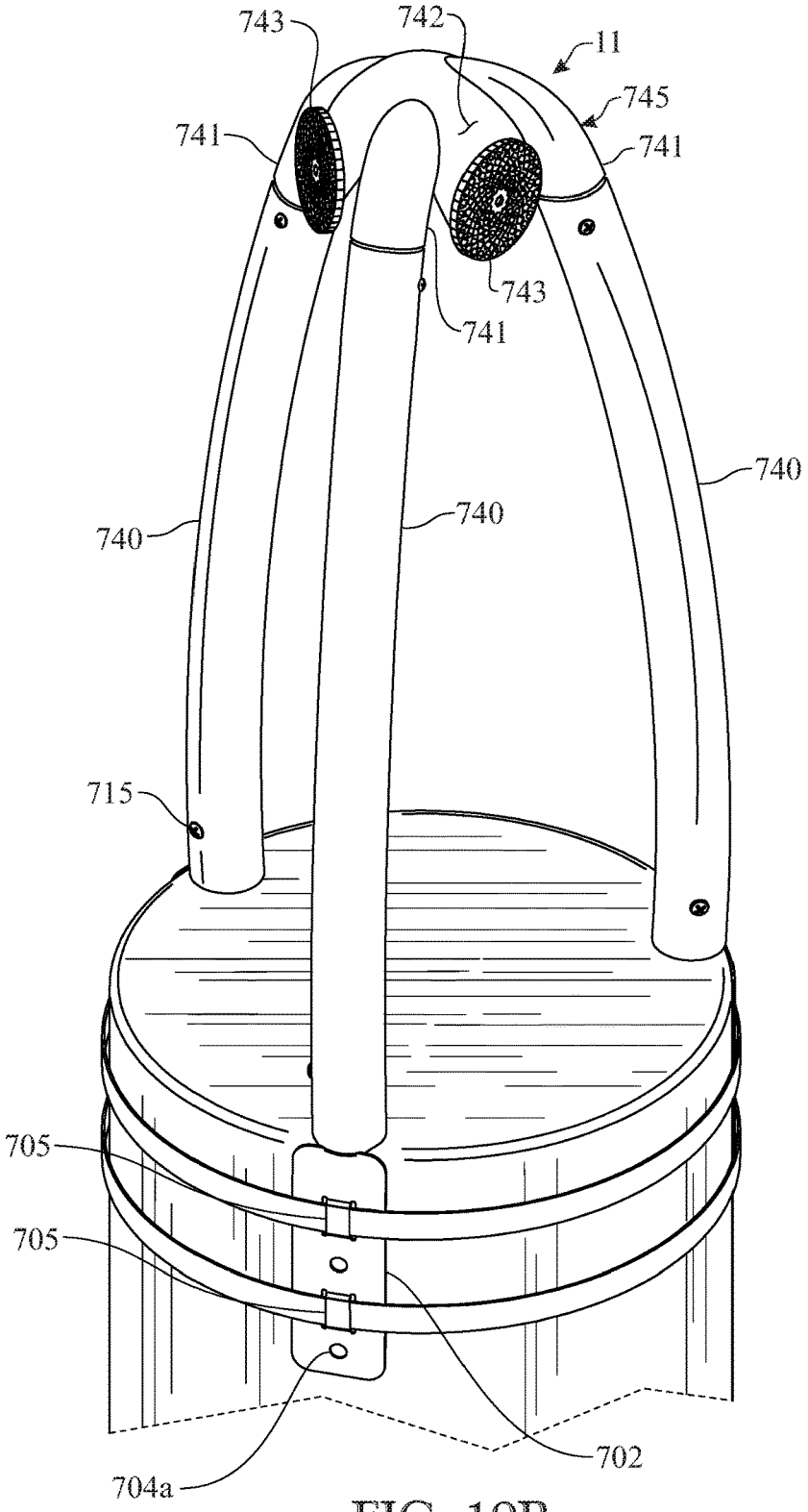
FIG. 19B is a perspective view of a sixth embodiment of the of the device for mounting on a piling.
Figure 20A:
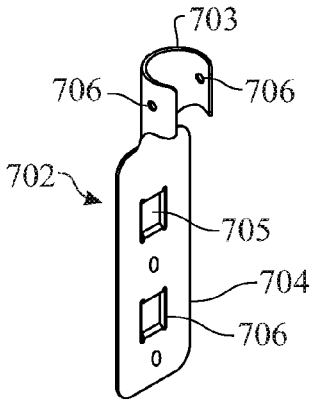
FIGS. 20A-20D are enlarged views of connectors of FIGS. 19A and 19B.
Figure 20B:
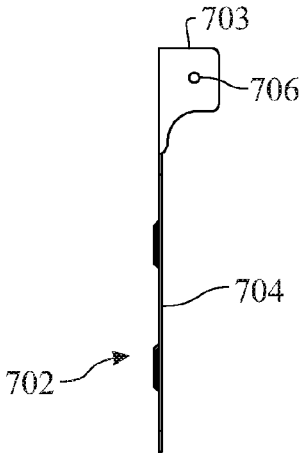
Figure 20C:
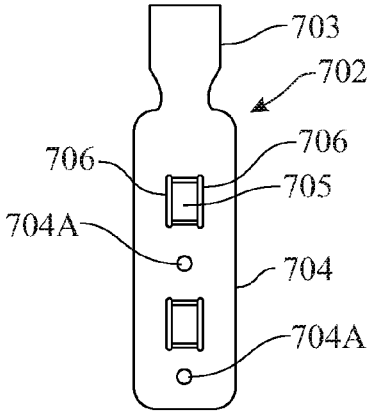
Figure 20D:
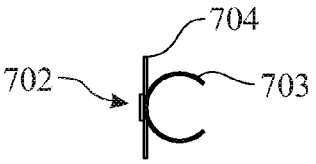

FIGS. 19A and 19B show two further embodiments of the device 1, which provides for mounting the device 1 to a piling 700. The difference between the embodiments lies in the fact that FIG. 19A has four lateral posts 740, while FIG. 19B has three lateral posts 740. The connectors 702 for attaching the device 1 to the piling 700 can be applied in either of the embodiments of FIG. 19A or 19B. In the piling mounting embodiments, the lateral posts 740 are connected to one another at the distal end 11 by a connection piece 745 that defines respective mounting segments 741 for each of the lateral posts 740. As shown in the in the Figures, the lateral posts 740 receive the mounting segments 741 therein, however it is possible that the mounting segments 741 can be dimensioned to receive the lateral posts therein. As shown, the mounting segments 741 are provided with a step so that an outer diameter of the lateral posts 740 is flush or below the surface of the abutting portion of the mounting segments 741 so as to prevent mooring lines from being caught and hung up on an edge of the lateral posts 740. This in turn allows a loop of a mooring line to reach the piling 700 without being hindered. The connection element 745 has webs 742 between the mounting segments 741, which webs 742 interconnect adjacent mounting segments 741 with one another. The webs 742 are below an umbrella defined by the outermost surfaces of the mounting segments 741 so that the webs 742 do not interfere with mooring lines sliding over the device. The webs 742 also serve to mount reflectors 743, which are also below the umbrella.

FIGS. 20A-20D respectively show an enlarged perspective view, side view, plan view and end view of a blade connector 702. The blade connector 702 has a semi-cylindrical shank portion 703 extending from a plate body 704. The semi-cylindrical shank portion 703 is dimensioned and constructed so as to fit inside the lateral posts 740 and mechanical fasteners 715 are inserted through the lateral post 740 and through opposing openings 706 in the shank portion 703 to secure the blade connectors 702 to the lateral posts 740. As seen in FIGS. 19A and B, a base of the shank portion 703 is perpendicular to the plate body 704, which aids in mounting the device 1 to a piling. The plate body 704 is provided with at least one tab 705 that is displaced from a surface of the plate body 704. The tab 705 is delimited by opposing longitudinal slots 706 that are aligned with a longitudinal direction of the plate body 704. The longitudinal slots 706 accommodate the hose clamp 701 and allows the hose clamp 701 to pass under the respective tabs 705 through each of the blade connectors 702 and run around the piling 700 to fasten the device 1 to the piling 700. The Figures show that the ends of the tab 705 are continuous with the plate body 704, however, it is possible that one of the ends may be removed/open so that the tab 705 is of a cantilever construction, which allows the hose clamp 701 to be more easily slid under the tab 705. Specifically, this construction allows the hose clamp 701 to be more easily installed, as the clamp 701 can be slid under the tab 705 via the open end and clamp 701 does not need to be fully opened (the ring remains intact) to be inserted under the tab 705. In addition to the tabs 705 or as an alternative to the tabs 705, the plate body 704 may be provided with apertures 704*a*, which may receive a mechanical fastener (not shown), such as screws or nails to help hold the device in place when mounting the clamp 701 or as an alternative way to attach the plate body 704 to the piling 700.

We claim:

1. A cleat attachable device for attaching to a cleat having horns, the device comprising:

a frame having a base end, a distal end opposite said base end, and lateral posts, said lateral posts being disposed opposite one another and being connected to one another at said distal end, said lateral posts each having a respective mounting plate with a longitudinal slot formed therein;

a fastener passing through each said longitudinal slot for fixing a position of each said respective mounting plate relative to one another and setting a distance of said lateral posts from one another at said base end, the distance corresponding to a length of the horns of the cleat; and each of said mounting plates having a respective hose clamp for fastening said frame onto the cleat.

2. The cleat attachable device according to claim 1, wherein said mounting plates each have respective opposing notches for receiving said respective hose clamp therein.

3. The cleat attachable device according to claim 2, wherein said mounting plates each have bosses for attaching to a respective one of said lateral posts.

4. The cleat attachable device according to claim 3, wherein said opposing notches are adjacent said bosses.

5. The cleat attachable device according to claim 1, wherein said mounting plates each have a respective shoulder on an underside thereof for abutting against an end of a horn of the cleat.

6. A piling attachable device for attaching to a piling, the device comprising:

a frame having a base end, a distal end opposite said base end, and three lateral posts, said lateral posts being radially spaced apart from one another and being connected to one another at said distal end;

each of said lateral posts having a respective blade connector with a shank portion mounting said blade connector to a corresponding one of said lateral posts.

7. The piling attachable device according to claim 6, wherein each said blade connector includes a body portion affixed to said shank portion, said body portion has apertures formed therein for fasteners that fasten each said blade connector to the piling.

8. The piling attachable device according to claim 7, wherein said shank portion has a base end, said base end is orthogonal to said body portion.

9. The piling attachable device according to claim 6, wherein said shank portion is inserted into said corresponding one of said lateral posts.

10. A piling attachable device for attaching to a piling, the device comprising:

a frame having a base end, a distal end opposite said base end, and three lateral posts, said lateral posts being radially spaced apart from one another and being connected to one another at said distal end, said lateral posts each having respective slots at said base end;

a hose clamp inserted through said respective slots for securing said frame onto said piling.

11. The piling attachable device according to claim 10, wherein each of said lateral posts has a respective blade connector in which said slots are provided.

12. The piling attachable device according to claim 11, wherein each said blade connector has a shank portion that mounts said blade connector to a corresponding one of said lateral posts.

13. The piling attachable device according to claim 12, wherein said shank portion is inserted into said corresponding one of said lateral posts.

14. The piling attachable device according to claim 12, wherein said corresponding one of said lateral posts is inserted into said shank portion.

15. The piling attachable device according to claim 11, wherein said blade connector has a body portion having a surface and slots are delimited by said body portion and by a tab that is offset from said surface of said body portion.

* * * * *